US009192543B2

(12) United States Patent
Hunkeler et al.

(10) Patent No.: US 9,192,543 B2
(45) Date of Patent: Nov. 24, 2015

(54) BLINDING DEVICE

(71) Applicant: Fisher Clinical Services GmbH, Allschwill (CH)

(72) Inventors: Guido Hunkeler, Schonenbuch (CH); Joerg Spettl, Loerrach (DE)

(73) Assignee: FISHER CLINICAL SERVICES GmbH, Allschwil (CH)

( * ) Notice: Subject to any disclaimer, the term of this patent is extended or adjusted under 35 U.S.C. 154(b) by 0 days.

(21) Appl. No.: 13/861,709

(22) Filed: Apr. 12, 2013

(65) Prior Publication Data

US 2013/0299446 A1 Nov. 14, 2013

(30) Foreign Application Priority Data

May 8, 2012 (CH) ..... 637/12

(51) Int. Cl.

| | |
|---|---|
| ***B65D 41/56*** | (2006.01) |
| ***B65D 1/24*** | (2006.01) |
| ***B65D 1/36*** | (2006.01) |
| ***A61J 1/14*** | (2006.01) |
| ***A61J 1/16*** | (2006.01) |
| ***B65D 77/04*** | (2006.01) |
| ***B65D 51/18*** | (2006.01) |

(52) U.S. Cl.

CPC *A61J 1/14* (2013.01); *A61J 1/1412* (2013.01); *A61J 1/16* (2013.01); *B65D 51/18* (2013.01); *B65D 77/048* (2013.01); *A61J 1/1406* (2013.01); *B65D 2251/0015* (2013.01); *B65D 2251/0078* (2013.01)

(58) Field of Classification Search

CPC ..... B65D 51/28; B65D 17/166; B65D 1/28; B65D 81/3216; B65D 47/265; Y10S 215/03; Y10S 215/07; Y10S 220/909; A61J 1/16; A61J 1/1412; A61J 1/20

USPC ..... 220/212, 502, 505, 521–529; 206/733, 206/734; 215/228, 247, 258, 264, 265; 222/129, 183

See application file for complete search history.

(56) References Cited

U.S. PATENT DOCUMENTS

| | | | | |
|---|---|---|---|---|
| 2,438,906 | A * | 4/1948 | Elsas et al. | 222/108 |
| 2,750,066 | A * | 6/1956 | Shekter | 220/521 |
| 4,949,858 | A * | 8/1990 | Sheridan | 215/330 |
| 5,143,261 | A * | 9/1992 | Drobish | 222/129 |
| 5,590,782 | A | 1/1997 | Haber et al. | |
| 2004/0129596 | A1 | 7/2004 | Geert et al. | |
| 2007/0163914 | A1 | 7/2007 | Gehring et al. | |
| 2013/0240535 | A1 * | 9/2013 | Grajqevci | 220/524 |

FOREIGN PATENT DOCUMENTS

| | | |
|---|---|---|
| AU | 441022 | 9/1973 |

OTHER PUBLICATIONS

International Search Report issued Feb. 15, 2013, in Swiss Patent Application No. CH 6372012, filed May 8, 2012.

* cited by examiner

*Primary Examiner* — Shawn M Braden

(74) *Attorney, Agent, or Firm* — Oblon, McClelland, Maier & Neustadt, L.L.P.

(57) ABSTRACT

A blinding cover completely surrounding the container comprises an axially movable and twistable lid that has means for gripping the sealing cap of the container and has a sampling point for a sampling needle. By axially moving and twisting the lid, the sealing cap is removed from the container, and the sampling point is positioned above the open container.

1 Claim, 2 Drawing Sheets

BLINDING DEVICE

The invention related to a device for blinding containers for clinical studies.

As is well known, it has to be made sure for clinical studies that the probands are not able to visually differentiate between different preparations. If the different preparations, i.e., thus, e.g., verum and placebo, are placed in identical containers, but exhibit visual differences (color, consistency, etc.), it is sufficient to provide the containers with an opaque cover. However, if the preparation containers are provided with an additional identification, for example, a colored sealing cap, the known blinding measures are not sufficient.

For the purpose of this description, the terms "container" or "preparation container" are used for small vials in which usually preparations, i.e., normally liquid pharmaceuticals, are provided for clinical studies.

It is an object of the invention to enable a blinding of containers that covers the entire container and makes it impossible during a clinical study to identify the container or the content thereof.

According to the invention, this is achieved by a blinding device for blinding a container having a sealing cap to be removed for the purpose of preparation sampling. The blinding container comprises a blinding cover that completely surrounds the container, and a lid that is connected to the blinding cover so as to be axially movable between lower and upper positions, and is rotatable relative to the container, when in the upper position, about an axis that is eccentric relative to the container. The lid includes a gripper for gripping the sealing cap, and a sampling point for a sampling needle, wherein the gripper and sampling point are arranged on the lid such that rotating the lid causes the sealing cap gripped by the gripper to be is removed from the container and the sampling point is positioned above the open container.

Figure 1:
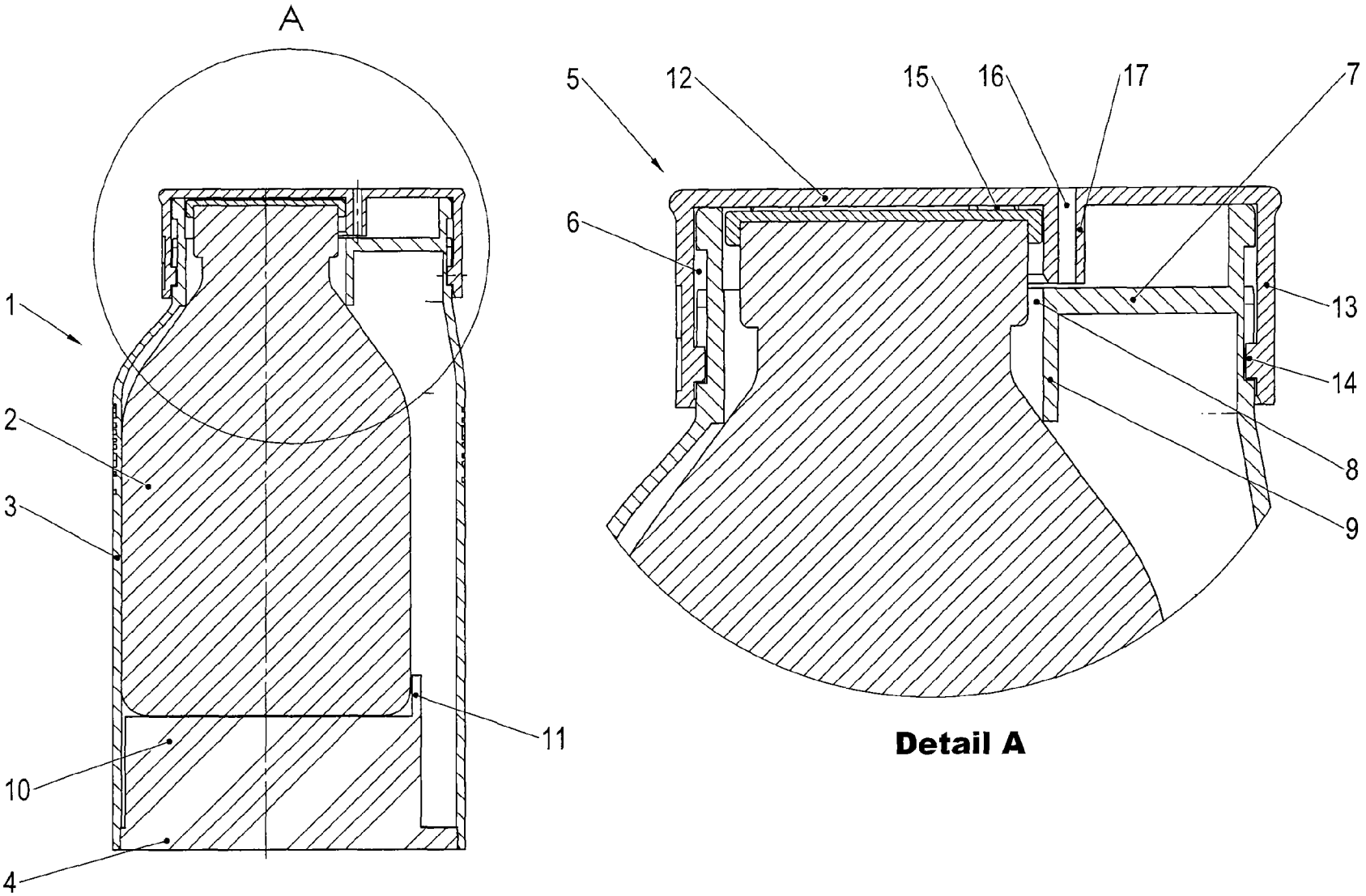
Figure 4:
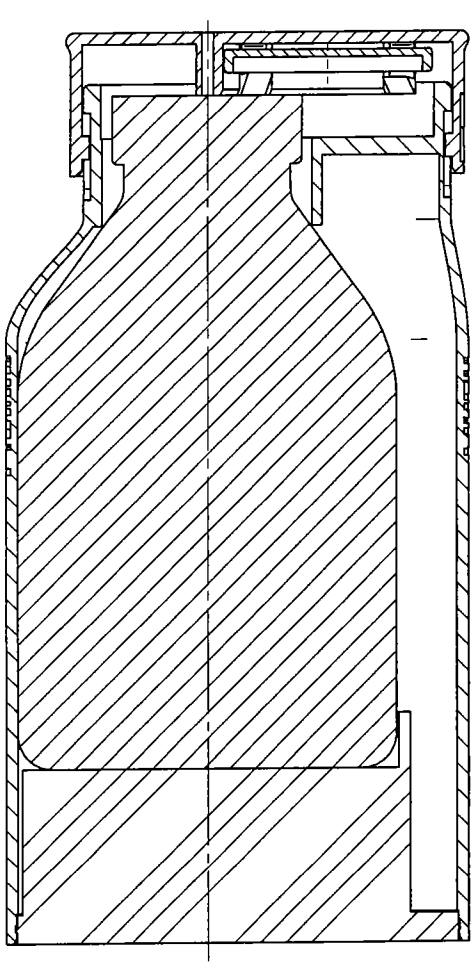
Figure 3:
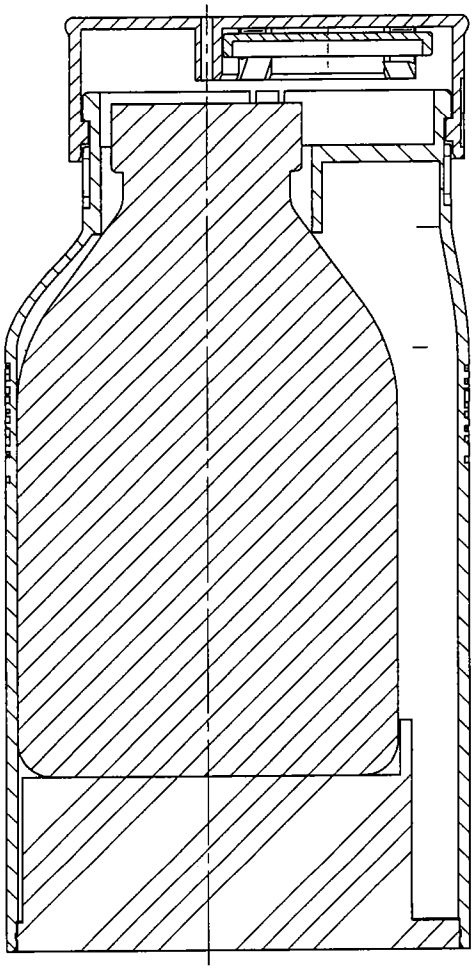
Figure 2:
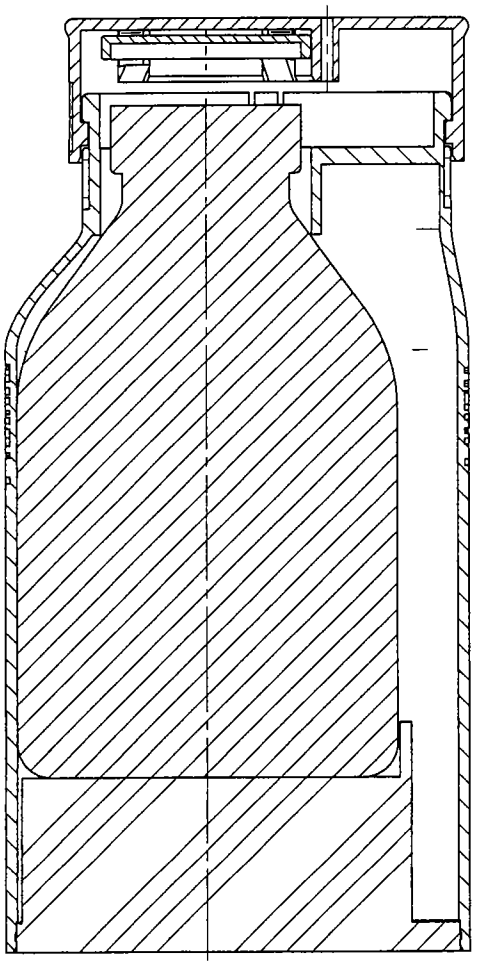

A preferred exemplary embodiment of the invention is described hereinafter with reference of the accompanying drawings. The drawings show a blinding according to the invention and different phases of opening the container for the purpose of preparation sampling, namely:

FIG. 1 shows a sectional view of a blinding cover with a container placed therein, in the closed state, FIG. 2 shows a blinding cover with the sealing cap removed from the container, FIG. 3 shows the blinding cover with the sealing cap turned away, FIG. 4 shows the position of container and blinding cover ready for preparation sampling.

The present described blinding cover concerns a rigid, hard-shell cover, in contrast to the known, easily deformable covers.

The blinding cover 1 for a container 2 consists of a center part 3, a bottom 4 inserted at the lower end of the center part, and a lid 5 arranged on the upper side of the center part.

The center part 3 has a cylindrical lower region with a diameter that is larger than the diameter of the container. In its upper region, the center part is tapered to a smaller diameter. Moreover, the upper region is laterally offset with its axis with respect to the axis of the lower region in such a manner that the transition between the lower and the upper regions of the center part is greatly inclined on one side, in the Figures on the left, and is only slightly inclined on the opposite side. Therebetween, there is a uniform course of the inclination.

On the outer side of the upper region of the center part, a circumferentially extending groove 6 is formed which, on the side of the greatly inclined transition and opposite thereto, is provided in each case with a downward-oriented junction.

The function of this groove and the junctions thereof is described hereinafter together with the function of the lid 5.

The container is arranged eccentrically on the side of the greatly inclined transition of the center part. For fixing the neck of the container, a support like a type of intermediate bottom 7 with an opening 8 and a skirt 9 is formed below the upper end of the center part, which skirt is oriented downward and transitions on the side of the greatly inclined transition into the wall of the upper region. The neck of the container extends through the opening, wherein the tapered region of the neck is held by the lower edge of the skirt.

The lower side of the container is also fixed in this position, namely by the bottom 4 which, for this purpose, has on one side an upward-facing thickening 10 through which the container is pressed upward against the lower edge of the skirt, and is provided on the other side with an upward-protruding rim 11 for laterally fixing the container. After inserting the container, the bottom is pressed into the lower opening of the center part.

Containers, the diameter of which is not or only insignificantly larger over their entire axial length than the diameter of the sealing cap cannot be fixed in the cover in this manner. However, in order to nevertheless fix them axially, suitable webs can be arranged inside the cover, and/or the cover, e.g., can consist of two half shells split in the longitudinal direction.

The lid 5 consists of a flat cover part 12 corresponding to the upper opening of the center part, and of a downward-facing skirt 13 that engages around the upper edge of the center part. Near the lower edge of the skirt, two inward-facing cams 14 are formed which are arranged opposite to each other and engage in the above-described groove 6. Through this engagement, the lid is connected to the center part. When the cams engage in the downward-facing junctions, the lid can be moved axially with regard to the center part. In its upper position, the lid can be twisted with respect to the center part by guiding the cams in the circumferentially extending groove.

On the lower side of the flat cover part 12, a plurality of gripping elements 15 in the form of hooks are attached which engage below the sealing cap of the container. At the same distance as the axis of the container from the axis of the upper region of the center part, offset by 180 degrees, a sampling point is arranged, in the present case a through-opening 16 provided with a tubular, downward-facing extension 17 for a sampling needle for sampling a preparation amount from the container. Depending on the application, the through-opening can be closed by an elastic plug or the like, which is pierced with the needle for sampling.

The arrangement shown in FIG. 1 illustrates the situation of the blinded container for storage, transport etc., i.e., for the provision for the purpose of a clinical study. The cams of the lid are at the lower ends of the junctions coming from the circumferentially extending groove. In order to remove a certain amount of the preparation, the lid, starting from the situation according to FIG. 1, is lifted until the cams 14 reach the height of the circumferentially extending grooves, as shown in FIG. 2. By lifting the lid, the sealing cap is lifted off the container by the gripping elements. As the next step, the lid with the sealing cap removed from the container is twisted by 180°, as shown in FIG. 3, so that the sealing cap is situated as lateral as possible from the opening of the container and, at the same time, the through-opening is situated above the opening of the container. Due to the twisting by 180°, the cams are situated again above the junctions of the groove so that the lid, as shown in FIG. 4, can be moved axially downward again so as to fix the reached position.

The invention claimed is:

1. A device for blinding a container having a sealing cap to be removed for the purpose of preparation sampling, comprising:

a blinding cover that completely surrounds the container, a lid that is connected to the blinding cover so as to be axially movable between lower and upper positions, and is rotatable relative to the container, when in the upper position, about an axis that is eccentric relative to the container, the lid including a gripper for gripping the sealing cap, and a sampling point for a sampling needle, wherein the gripper and sampling point are arranged on the lid such that axial movement of the lid to its upper position causes the sealing cap gripped by the gripper to be is removed from the container opening and subsequently rotating the lid causes the sealing cap to be displaced from above the container opening and the sampling point is positioned above the open container.

* * * * *